United States Patent [19]

Homma

[11] Patent Number: 4,478,351

[45] Date of Patent: Oct. 23, 1984

[54] COMPOUND PACKING CONTAINER

[75] Inventor: Yoshihiro Homma, Urawa, Japan

[73] Assignee: Hokkai Can Co., Ltd., Tokyo, Japan

[21] Appl. No.: 440,527

[22] Filed: Nov. 10, 1982

[30] Foreign Application Priority Data

Nov. 11, 1981 [JP] Japan ..... 56-166966[U]

[51] Int. Cl.[3] ..... B65D 90/04

[52] U.S. Cl. ..... 220/462; 220/463

[58] Field of Search ..... 220/462, 463, 461, 416, 220/418

[56] References Cited

U.S. PATENT DOCUMENTS

| | | | |
|---|---|---|---|
| 2,930,517 | 3/1960 | Mensing et al. | 229/14 |
| 3,363,822 | 1/1968 | Maulini et al. | 220/462 |
| 3,416,717 | 12/1968 | Beck, Jr. et al. | 220/462 |
| 3,459,357 | 8/1969 | Egger et al. | 229/37 |
| 3,550,833 | 12/1970 | Rahenkamp | 229/17 |
| 3,578,234 | 5/1971 | Marchisen | 220/462 |
| 3,902,652 | 9/1975 | Malcolm | 220/462 |
| 4,197,963 | 4/1980 | Nerenberg | 220/462 |

FOREIGN PATENT DOCUMENTS

| | | |
|---|---|---|
| 945217 | 12/1963 | United Kingdom . |
| 1273350 | 5/1972 | United Kingdom . |

*Primary Examiner*—Joseph Man-Fu Moy
*Attorney, Agent, or Firm*—Armstrong, Nikaido, Marmelstein & Kubovcik

[57] ABSTRACT

A compound packing container consisting of an outer casing made of a paper material having an inner bag member arranged to be contained therein. The outer casing has a series of adjacent first, second, third and fourth side panels arranged to be formed into a tubular drum portion with first, second, third and fourth upper flaps and first, second, third and fourth lower flaps extending respectively upwards and downwards from the side panels through an upper and a lower horizontal fold. A pair of opposite vertical folds are made in the vertical center portions of the first side panel, the first upper flap and the first lower flap and in the vertical center portions of the third side panel, the third upper flap, and the third lower flap. The flat inner bag member is made of a rectangular waterproof sheet arranged in the outer casing having front and rear sheet portions, opposite side edges extending along the whole length of the opposite vertical folds of the outer casing, a bottom closed edge and an open top edge having an opening defined by the front and rear sheets. Both sides of an intermediate portion of the inner bag member are adhered to the inner surface of the side panels and both surfaces of each of the bottom portions around the corners on both ends of the bottom edge are adhered respectively to the first and third lower flaps at each of two triangular adhesion regions. The triangular adhesion regions have apexes at the lower ends of the vertical folds.

1 Claim, 14 Drawing Figures

FIG.3a
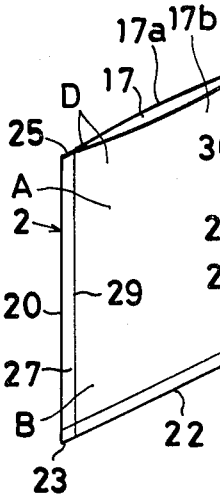
FIG 3b
FIG.3c
FIG.4
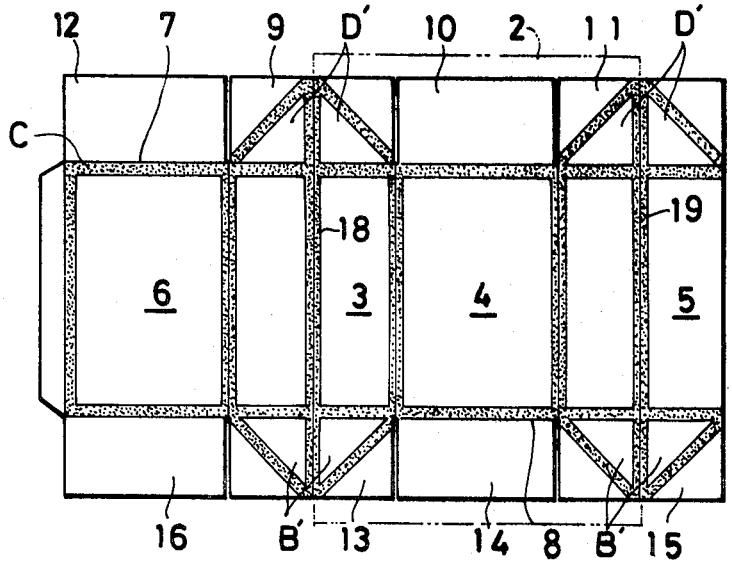

COMPOUND PACKING CONTAINER

BACKGROUND OF THE INVENTION

The present invention relates to a compound packing container and, more specifically to a double container in which an inner bag member made of a waterproof sheet material is contained in an outer container made of a paper material such as paper, paperboard, or corrugated cardboard.

Previously, various proposals on improvements in construction of this kind of packing container have been made and put into practical usse. However, a typical container of the prior art constructed by forming waterproof sheet material into a tubular member. The tubular member is then inserted into an outer tubular casing. Thereafter, the inner tubular member is tightly sealed at its lower edge and is charged with the material to be packaged. The inner member is then tightly sealed at its upper edge. In addition, it is further required that the outer tubular casing be closed at its lower and upper ends. Thus, the manufacturing and packing process is complicated and time consuming.

To eliminate this problem, there has been recently proposed a container constructed by forming a waterproof sheet material into a self-opening square bag member of gusseted type. The bag member is inserted in an outer tubular casing, as disclosed, for instance, in Japanese Utility Model Publication No. 39297/Showa 50 (1975). However, this type of double container is defective in that manufacturing of the self-opening gusseted type bag member is burdened with difficulties and consequently is liable to insufficient sealing at the gusseted portions.

OBJECTS AND SUMMARY OF THE INVENTION

The present invention has as an object to provide a compound packing container which is simple to manufacture.

It is a further object of the invention to provide a compound packing container having an inner bag member in an outer container in which the inner bag member is reliably and simply sealed.

It is still a further object of the present invention to provide a compound packing container which is simple to store and transport in an empty condition and is simple and easy to use.

The above and other objects are attained in a compound packing container consisting of an outer casing and an inner bag wherein the outer casing is made of a paper material having a series of adjacent first, second, third and fourth side panels arranged to be formed into a tubular drum portion. First, second, third, and fourth upper flaps and first, second, third and fourth lower flaps extend respectively upwards and downwards from the first, second, third and fourth side panels through an upper horizontal fold and a lower horizontal fold. A pair of opposite vertical folds are provided in the vertical center portions of the first side panel, the first upper flap and the first lower flap and in the vertical center portions of the third side panel, the third upper flap, and the third lower flap. The outer casing is formed into a tubular shape by connecting both ends of the series of side panels such that the tubular shape may be folded and unfolded into a flat tubular condition and an expanded open square tubular condition, respectively at the opposite vertical folds. The flat inner bag member is made of a rectangular waterproof sheet and is arranged to be contained in the outer casing. The inner bag member has front and rear sheet portions, opposite side edges extending along the whole length of the opposite vertical folds of the outer casing, a closed bottom edge and an open top edge having an opening defined by the front and rear sheet portions. The bag has both edges of an intermediate portion adhered to the inner surfaces of the side panels of the outer casing and both surfaces of each of both corner portions around the corners from both ends of the bottom edge are adhered respectively to the first and third lower flaps at each of two triangular adhesion regions on the first and third lower flaps. The triangular adhesion regions have apexes at the lower ends of the vertical folds of the outer casing.

The opposite side edges of the inner bag member can be adhered together and have adhered sealed portions inwardly bent. These bent surface portions can be adhered to the inner surfaces of the outer casing along the vertical folds in its flat, tubular condition.

BRIEF DESCRIPTION OF THE DRAWINGS

The above and other objects and the attendant advantages of the present invention will become readily apparent by reference to the following detailed description when considered in conjunction with the accompanying drawings wherein:

FIGS. 3*a*, 3*b*, 3*c* are perspective views of various types of inner bag members for use in the present invention;

FIG. 4 is a plan view of an outer container thereof in its developed, unfolded, flat condition;

DETAILED DESCRIPTION OF PREFERRED EMBODIMENTS

Figure 1:
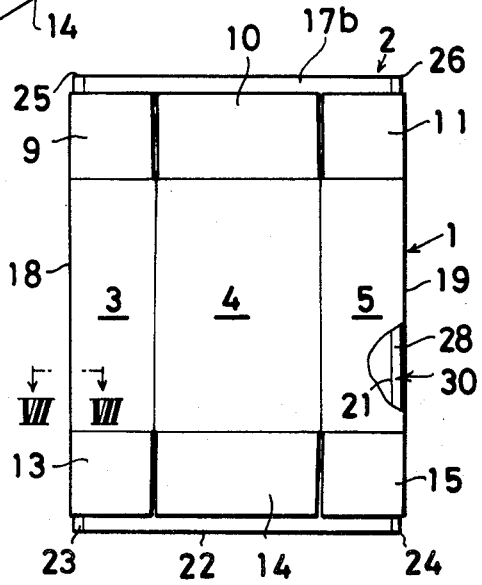
FIG. 1 is the front view, partially omitted, of one example container of the present invention in its folded condition.

One example of this invention will now be explained with reference to the accompanying drawings:

FIG. 1 shows one exemplified container of this invention in its folded flat condition. An outer casing 1 is made of cardboard such as a corrugated cardboard or the like. An inner bag member 2 is made of a waterproof sheet material such as a plastic film, an aluminum foil or the like, and is formed flatly.

As shown in FIG. 4, the outer casing 1 consists of a series of first, second, third and fourth side panels 3, 4, 5 and 6 arranged to be formed into a tubular drum shape as shown in FIG. 1 by adhering both ends of the series together. First, second, third, and fourth upper flaps 9, 10, 11, 12 and the first, second, third and fourth lower flaps 13, 14, 15, 16 extend respectively upwards and downwards from side panels 3, 4, 5, and 6 through upper and lower horizontal folds 7, 8.

Figure 2:
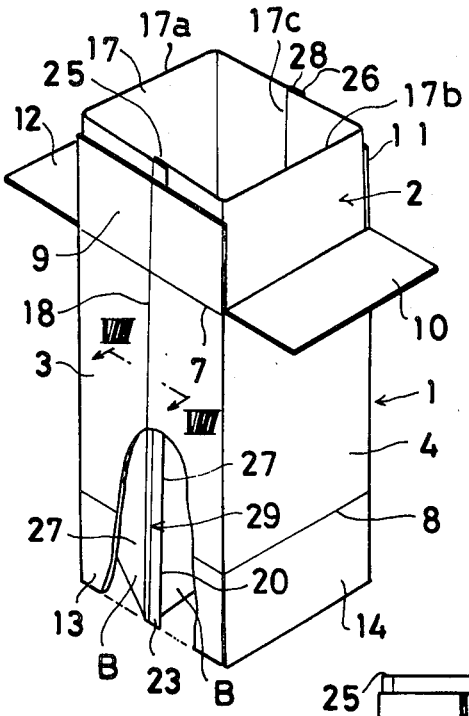
FIG. 2 is a perspective view, partially omitted, of the same in its expanded open condition.

The outer casing 1 is provided with a pair of opposite vertical folds 18, 19 in the vertical center portions of the first side panel 3, the first upper flap 9 and the first lower flap 13 and in the center vertical portions of the third side panel 5, the third upper flap 11 and the third lower flap 15 so that after the outer casing 1 is formed into a tubular shape by connecting both ends of the series of the side panels thereof, the tubular shape can be folded and unfolded into a flat tubular condition as shown in FIG. 1 and can be expanded into open square tubular condition as shown in FIG. 2, respectively, at the opposite vertical folds 18, 19.

The flat type inner bag member 2 has opposite side edges 20, 21, a closed bottom edge 22 and an open top edge having an opening 17 defined by front and rear sheet portions 17*a*, 17*b*. It is arranged to be contained in the foregoing tubular-casing 1. A three-side adhered sealed inner bag member 2 can be prepared by placing two square sheets one upon another and adhering them together at the opposite side edges 20, 21 to form adhered sealed portions 27, 28 and the bottom edge 22 as shown in FIG. 3*a*. A two-side adhered sealed inner bag member 2 can be prepared by folding a single sheet and adhering it together only at the opposite side edges 20, 21 to form adhered sealed portions, 27, 28 as shown in FIG. 3*b*, or by folding and adhering the edges and envelope sealed as shown in FIG. 3*c*.

In the illustrated example of this invention, the flat inner bag member 2 as shown in FIG. 3*b* is used. This invention container is constructed preferably in the following way, for example.

The inner bag member 2 is positioned on the region between the vertical folds 18, 19 of the inner surface of the outer casing 1 which is in its developed, unfolded, flat condition and has been previously coated with an adhesive agent C at predetermined portions as shown in FIG. 4. Thereafter, the outer casing 1 is folded at the vertical folds 18, 19 so that the folded-over portions may be placed on the inner bag member 2, to obtain this invention container in its flat condition shown in FIG. 1. The inner bag member 2 is so combined with the outer casing 1 as shown clearly in FIG. 2 that: (1) the opposite side edges 20, 21 extend along on the inner surfaces of the folds 18, 19 of the outer casing, (2) both sides A, A of an intermediate portion of the inner bag member 2 are adhered to the inner surfaces of the side panels 3, 4, 5 and 6 of the outer casing 1, (3) both surfaces B, B of each of both corner portions around the corners 23, 24 on both ends of the bottom edge 22 are adhered respectively to the first and third lower flaps 13, 15 at each of triangular adhesion regions B', B' of which the apexes are at the lower ends of the vertical folds 18, 19.

It is preferable that as clearly shown in FIG. 4 and FIG. 6 that the open top edge side of the inner bag member 2 is at its both corner portions D, D adhered to respective triangular adhesion regions D', D' the first and third upper flaps 9, 11 in the same manner as above.

Next, the operation of the resultant double container of the present invention will be explained as follows:

This container is as desired unfolded at the vertical folds 18, 19 of the outer casing 1 into an open square condition as shown in FIG. 2 from its flat condition shown in FIG. 1. When the container is folded into a flat condition at the folds 18, 19, the inner bag member 2 is not subjected at all to any undue force by the folding operation and can be easily formed into its original, flat condition. In addition, the resultant flat container is convenient because plural containers can be piled one upon another for being stored and also can be tied up in a bundle for being conveyed.

When it is intended to put materials in this container, the container in its flat condition is opened into a square form container by pushing the opposite side panels 3, 5 of the outer casing 1 so that those side panels 3, 5 may be unfolded into stretched condition as shown in FIG. 2.

Figure 5A:
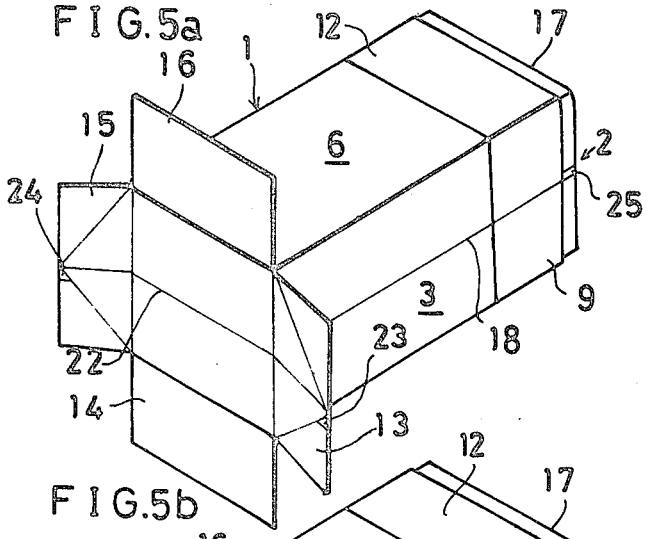
FIGS. 5*a*, 5*b*, 5*c* are perspective views including sealing steps of the lower flaps of the outer container.

In this case, as shown in FIG. 5, according to such an opening operation, the bottom edge 22 of the inner bag member 2 is expanded into a square bottom by outwardly pulling action of the opposite side panels 6, 4 of the tubular outer casing 1. At the same time, the corner portions of the inner bag member 2 are bent and formed into triangular forms corresponding to the triangular forms of the adhesion regions B', B' of the outer casing 1.

Figure 5B:
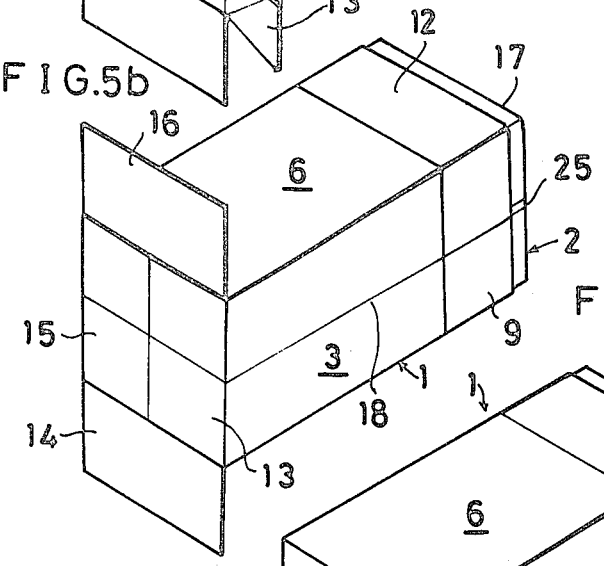
Figure 5C:
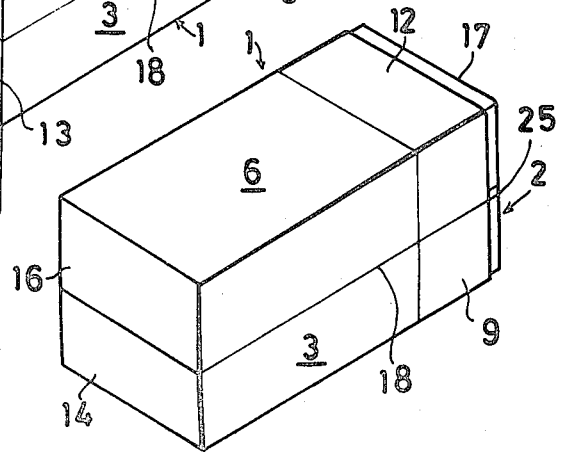

Thus, after the open square container having the square bottom of the inner bag member 2 surrounded by the square lower ends of the outer casing 1 is obtained as shown in FIG. 5, the same is sealed by the lower flaps 13, 15 and the lower flaps 14, 16 in the order shown in FIG. 5*b* and 5*c*. In this closing operation, no creases, wrinkles or deformation in the bottom edge 22 of the inner bag member 2 will occur.

Figure 6A:
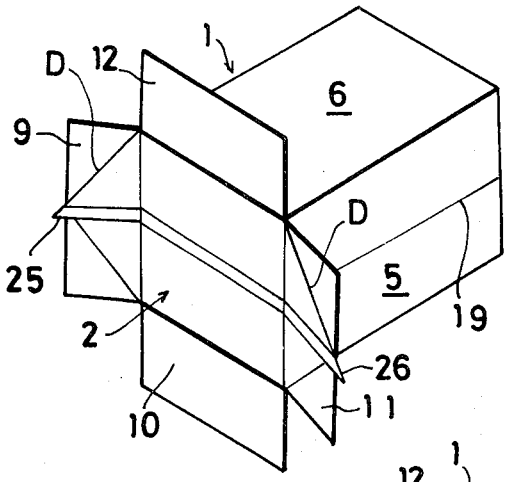
FIGS. 6*a*, 6*b*, 6*c* are perspective views including sealing steps of the upper flaps of the outer container.
Figure 6B:
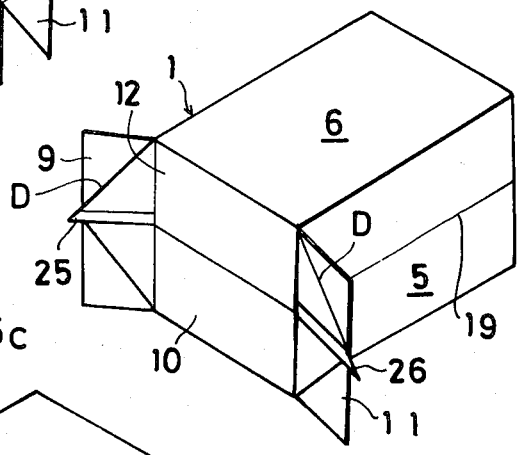
Figure 6C:
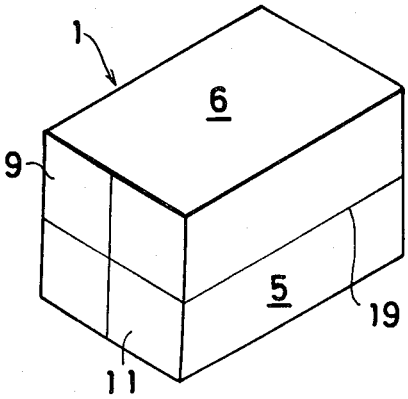

Next, any type of material such as liquid, powder, etc. is charged therein through the opening 17 of the upper portion of the inner bag member 2. Thereafter, the upper flaps 9 and 11 are opened outwardly and the edges of the opening 17 are sealed, as shown in FIG. 6*a*. The upper flaps 10 and 12 and the upper flaps 9 and 11 are closed in the order as shown in FIG. 6*b* and FIG. 6*c*. During this operation, the corner portions including the corners 25, 26 are formed into their triangular forms and are folded back inside of the closed flaps 9 and 11.

Figure 7:
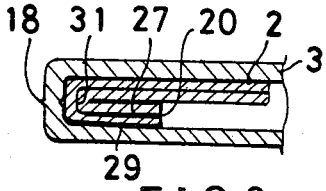
FIG. 7 is a sectional view taken along the line VII—VII in FIG. 1.
Figure 8:
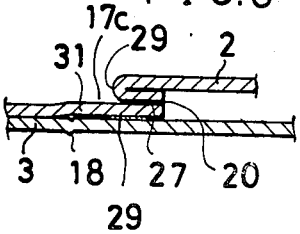
FIG. 8 is a sectional view taken along the line VIII—VIII in FIG. 2.

In the case of using the flat inner bag member 2 of the type that the opposite side edges 20, 21 have the adhered sealed portions 27, 28, the inner bag member 2 may be contained in the outer casing 1 in such a condition that the adhered sealed portions 27, 28 are left as they are as shown in FIG. 3*a* or FIG. 3*b*. However, it may be preferrably modified that the inner bag member 2 is contained therein with the adhered sealed portions 27, 28 are being bent inwards as shown in FIG. 1 and FIG. 7. More in detail, the adhered sealed portions 27, 28 thereof are bent inwards to form therein respective bent surface portions 29, 30 and the inner bag member 2 is adhered at its bent surface portions 29, 30 to the inner surfaces along on the vertical folds 18, 19 of the outer casing 1. Consequently, more close contact and adhering of the inner bag member 2 to the opposite inner surfaces of the outer casing can be obtained. And at the same time, such an additional advantage can be obtained that when the folded tubular outer casing 1 is unfolded at its folds 18, 19 to be opened, the sheet portions 17*a*, 17*b* of the inner bag member 2 are opened at its portion 17*c* not adhered together as shown in FIG. 8. Consequently, the adhered portion between the inner bag member 2 and the outer casing 1 is not subjected to any undue force generated by the opening operation. Any danger of breaking of inner bag member 2 can be prevented.

Thus, according to this invention, a flat bag which is easy to manufacture is used for the inner bag member 2 of this invention container. In spite of the fact that the inner bag member 2 is previously manufactured as one having a square bottom, when the outer casing 1 is opened into a square tubular form, the flat inner bag member 2 can be formed automatically into an open square bag having a square bottom in conjunction with the opening operation of the outer casing. This is because the corner portions, B, B around the corners 23, 24 of the bottom edge 22 are previously adhered to the lower flaps 13, 15 at the triangular form adhesion regions B′, B′ of the outer casing 1 and are bent to be formed into the corresponding triangular forms according thereto. The double-packing work of the bottom of this container can be carried out easily because the triangular portions of the inner bag member 2 are put in the outer casing simultaneously with the closing operation of the lower flaps 13–16. Also, the bottom edge 22 portion of the inner bag member 2 is not subjected to any undue force when the lower flaps 13–16 are folded for closing because the corner portions of the bottom edge 22 are retreated inwards according to closing operation of the flaps 13, 15.

It is readily apparent that the above-described compound packing container meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in describing the full scope of the invention.

What is claimed is:

1. A compound packing container consisting of an outer casing made of a paper material having a series of adjacent first, second, third and fourth side panels arranged to be formed into a tubular drum portion, first, second, third and fourth upper flaps and first, second, third and fourth lower flaaps which extend respectively upwards and downwards from said first, second, third and fourth side panels through an upper horizontal fold and a lower horizontal fold, a pair of opposite vertical folds in the vertical center portions of the first side panel, the first upper flap and the first lower flap and in the vertical center portions of the third side panel, the third upper flap and the third lower flap, the outer casing being formed into a tubular shape by connecting both ends of the series of the side panels such that the tubular shape may be folded and unfolded into a flat tubular condition and an expanded open square tubular condition, respectively, at the opposite vertical folds; and a flat, inner bag member made of a rectangular waterproof sheet arranged to be contained in the outer casing having front and rear sheet portions, opposite side edges extending along on the whole length of the opposite vertical folds of the outer casing, a closed bottom edge and an open top edge having an opening defined by the front and rear sheet portions, both sides of an intermediate portion of the inner bag member being adhered to the inner surfaces of the side panels of the outer casing, both surfaces of each of both corner portions around the corners on both ends of the bottom edge being adhered respectively to the first and third lower flaps at each of two triangular adhesion regions on the first and third lower flaps having apexes at the lower ends of the vertical folds of the outer casing, and the opposite side edges of the inner bag member having adhered sealed portions inwardly bent and being adhered at their bent surface portions to the inner surfaces along on the vertical folds of the outer casing in its flat tubular condition.

* * * * *